US008579649B2

(12) United States Patent
Ohyama

(10) Patent No.: US 8,579,649 B2
(45) Date of Patent: Nov. 12, 2013

(54) FLEXIBLE WIRING MEMBER WITH POSITIONING HOLES MOUNTED ON ANOTHER MEMBER WITH POSITIONING BOSSES

(75) Inventor: Kouichi Ohyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/388,698

(22) PCT Filed: Aug. 5, 2010

(86) PCT No.: PCT/JP2010/063337

§ 371 (c)(1),
(2), (4) Date: Feb. 3, 2012

(87) PCT Pub. No.: WO2011/016538

PCT Pub. Date: Feb. 10, 2011

(65) Prior Publication Data

US 2012/0129400 A1 May 24, 2012

(30) Foreign Application Priority Data

Aug. 5, 2009 (JP) ..... 2009-182755

(51) Int. Cl.
*H01R 13/64* (2006.01)

(52) U.S. Cl.
USPC ..... 439/374

(58) Field of Classification Search
USPC ..... 439/374, 378, 351–355
See application file for complete search history.

(56) References Cited

U.S. PATENT DOCUMENTS

2004/0216318 A1* 11/2004 Charest et al. ..... 33/645
2007/0249200 A1* 10/2007 Chen et al. ..... 439/159
2009/0104810 A1* 4/2009 Matsuzawa ..... 439/377
2011/0151685 A1* 6/2011 Hamner et al. ..... 439/65
2012/0309222 A1* 12/2012 Takei et al. ..... 439/374

FOREIGN PATENT DOCUMENTS

| | | | |
|---|---|---|---|
| JP | 40-3886 | Y1 | 2/1965 |
| JP | 2001-093564 | A | 4/2001 |
| JP | 2005-166420 | A | 6/2005 |
| JP | 2005-327612 | A | 11/2005 |
| JP | 2006-085989 | A | 3/2006 |
| JP | 2007-220437 | A | 8/2007 |

OTHER PUBLICATIONS

International Search Report (PCT/ISA/210), issued by the International Searching Authority in corresponding International Application No. PCT/JP2010/063337 on Aug. 31, 2010.
Japanese Office Action issued Jul. 2, 2013 in corresponding Japanese Patent Application No: 2009-182755.

* cited by examiner

*Primary Examiner* — Chandrika Prasad
(74) *Attorney, Agent, or Firm* — Sughrue Mion, PLLC

(57) ABSTRACT

A flexible concentrated wiring connector includes a flexible concentrated wiring member, a first member, a second member. The flexible concentrated wiring member is clamped between the second member and the first member. A second clearance is set to be greater than a first clearance. The first clearance is defined as a difference between an internal dimension and an external dimension in the width direction of the flexible concentrated wiring member in a state that a first positioning boss of the first member is inserted into the center of a first positioning hole of the flexible concentrated wiring member. The second clearance is defined as a difference between an internal dimension and an external dimension in the width direction in a state that a second positioning boss is inserted into the center of a second positioning hole.

8 Claims, 7 Drawing Sheets

FLEXIBLE WIRING MEMBER WITH POSITIONING HOLES MOUNTED ON ANOTHER MEMBER WITH POSITIONING BOSSES

TECHNICAL FIELD

The present invention relates to a flexible concentrated wiring connector.

BACKGROUND ART

In mutual connection among various kinds of electronic devices or electric devices, a flexible concentrated wiring member such as a flexible flat cable (FFC), a flexible printed circuit (FPC) or the like has been used in order to reduce a wiring space or improve a degree of freedom in wiring paths.

An FFC is constituted such that a plurality of arranged foil-like conductors are sandwiched by insulation films and terminals which are to be connected to other electric circuits are formed at respective both ends. An FPC is constituted such that a terminal formed of a plurality of foil-like conductors is formed at an edge of a flexible board so that an electric circuit formed on the flexible board connects an external circuit. The terminals of these flexible concentrated wiring members are usually connected to other electric circuits via detachable connectors.

In addition, since a terminal of a flexible concentrated wiring member has a low rigidity, the terminal has possibilities that a deformation or insufficient insertion occurs because of insertion resistance at a time when the terminal is inserted into a connector of a connection target. For this reason, in general, it is proposed that a terminal connection tool having a rigidity is attached to a terminal section of such a flexible concentrated wiring member, and thereby the flexible concentrated wiring member is inserted into a connector to be connected thereto (e.g., see Patent Document 1).

For example, a terminal connection tool of a flexible concentrated wiring member described in Patent document 1 includes a slider having projections which are formed on a loading face where a terminal section of the flexible concentrated wiring member is to be mounted and side faces extending to both end portions of the loading face, and a cover which is attached to the slider so as to press the terminal section of the flexible concentrated wiring member against the loading face. The cover has a longitudinal member extending in the width direction of the terminal section of the flexible concentrated wiring member, and engagement members which are vertically provided at respective both ends of the longitudinal member along side faces of the slider and each of which has, formed thereon, an opening constituting a latch section to be latched with the projection at the side face.

In a case where the terminal connection tool is assembled to the terminal section of the flexible concentrated wiring member, the terminal section of the flexible concentrated wiring member is mounted on the loading face of the slider and the engagement member of the cover is pressed down along the side faces of the slider in a state that the longitudinal member of the cover is aligned to the terminal section of the flexible concentrated wiring member, and thereby the latch portions of the engagement member are respectively engaged with the projections on the slider.

PRIOR ART DOCUMENTS

Patent Documents

Patent Document 1: JP-A-2006-85989

SUMMARY OF INVENTION

Problems that the Invention is to Solve

Meanwhile, as described in Patent Document 1, aligning at a time when the terminal connection tool is assembled to the flexible concentrated wiring member, is carried out in such a manner that positioning bosses formed on both end portions at outer sides in the width direction of the loading face of the slider are inserted into respective positioning holes formed on both end portions at outer sides in the width direction of the terminal section of the flexible concentrated wiring member.

However, since the slider is usually formed of a molded product of a synthetic resin, positions of the positioning bosses are varied among products in a certain degree. Particularly, a distance (hereinafter, referred to as a boss pitch) between two positioning bosses arranged at an interval in the width direction of the slider tends to be largely varied among products.

Thus, in a case where a boss pitch of a slider is varied, following problems may arise. That is, in a case where a boss pitch is smaller than a distance (hereinafter, referred to as boss hole pitch) of two positioning holes formed on the flexible concentrated wiring member, a deformation such as a warpage occurs on the terminal section and an adhesiveness thereof with the loading face is degraded in the assembling of the flexible concentrated wiring member, which possibly causes a failure of contact with a connection target. In contrast to the above, in a case where the boss pitch is greater than the boss hole pitch, assembling work itself of the flexible concentrated wiring member becomes difficult. When the assembling is forcedly carried out, an excessive load is applied to the positioning holes, which possibly causes the flexible concentrated wiring member to be damaged.

In order to solve the above problems in the assembling, it can be thought that the positioning hole is enlarged. However, when the boss hole is enlarged, a deviation of the flexible concentrated wiring member, i.e., the terminal section with respect to the slider occurs so that a positioning precision is degraded, thereby possibly resulting in a failure of contact with a connection target.

The purpose of the invention is to prevent the terminal section of the flexible concentrated wiring member from being deformed and to also prevent the flexible concentrated wiring member from being damaged, in a case where the terminal connection tool is assembled to the flexible concentrated wiring member.

Means for Solving the Problems

A flexible concentrated wiring connector according to the invention is adapted to support a terminal section of a flexible concentrated wiring member and is fitted to a mating connector when the terminal section is inserted into and connected to the mating connector. The flexible concentrated wiring connector includes the flexible concentrated wiring member, a first member having a loading face on which the terminal section of the flexible concentrated wiring member is to be mounted, and a second member that supports the flexible concentrated wiring member so as to cause the flexible concentrated wiring member to be clamped between the second member and the first member and presses the terminal section against the loading face. Positioning bosses are vertically provided on the first member at respective both end portions at the outer sides in the width direction of the loading face, and positioning holes into which the positioning bosses are to be inserted are provided on the flexible concentrated wiring member at respective both end portions at the outer sides in the width direction of the terminal section.

Here, a difference between an internal dimension of one of the positioning holes and an external dimension of one of the positioning bosses in the width direction of the flexible concentrated wiring member in a state that the one of the positioning bosses is inserted into the center of the one of the positioning holes, is referred to as a first clearance, a difference between an internal dimension of the other of the positioning holes and an external dimension of the other of the positioning bosses in the width direction of the flexible concentrated wiring member in a state that the other of the positioning bosses is inserted into the center of the other of the positioning holes, is referred to as a second clearance, and the second clearance is set to be greater than the first clearance.

With this, it is possible to give a margin to a fitting portion between the other of the positioning holes and the other of the positioning bosses, because the second clearance is enlarged. Therefore, in a case where the terminal connection tool is assembled to the flexible concentrated wiring member, it is possible to insert the other of the positioning bosses into the other of the positioning holes after the one of the positioning bosses is inserted into the one of the positioning holes, even when the boss pitch of the positioning bosses formed on the terminal connection tool is varied to a certain degree. Here, even when the boss pitch becomes great, it is possible to prevent the flexible concentrated wiring member from being damaged in the assembling thereof by setting the second clearance to a predetermined size capable of absorbing variation in the boss pitch. In contrast to the above, even when the boss pitch becomes small, the terminal section can be assembled in a state that the terminal section is in intimate contact with the loading face.

In addition, since movement of the terminal section assembled to the loading face in the width direction is restricted by the first clearance, the movement with respect to the loading face can be suppressed by setting the first clearance to be small so that the connection condition with the connector can be adequately maintained.

Further, preferably, in the flexible concentrated wiring connector according to the invention, a second clearance can be set to be greater than both a first clearance and a third clearance, with the proviso that a difference between a bore diameter of one of the positioning holes and an outer diameter of one of the positioning bosses in a state that the one of the positioning bosses is inserted into the center of the one of the positioning holes, is referred to as the first clearance, a difference between an internal dimension of the other of the positioning holes and an external dimension of the other of the positioning bosses in the width direction of the flexible concentrated wiring member in a state that the other of the positioning bosses is inserted into the center of the other of the positioning holes, is referred to as the second clearance, and a difference between an internal dimension of the other of the positioning holes and an external dimension of the other of the positioning bosses in a direction perpendicular to the width direction of the flexible concentrate wiring member in a state that the other of the positioning bosses is inserted into the center of the other of the positioning holes, is referred to as the third clearance.

In accordance with the above configuration, movement of the terminal section in the width direction of the loading face and the direction perpendicular to the width direction is restricted by the first clearance and the third clearance so that the movement of the terminal section with respect to the loading face can be restricted in the whole directions by setting those clearances to be small. Consequently, it is possible to more stabilize the connection condition with the connector and to more improve the electric reliability.

In these cases, the second clearance is set within a range in which the terminal section is intimately contactable with the loading face in the width direction thereof when the flexible concentrated wiring member is assembled to the first member.

Meanwhile, in the case where the flexible concentrated wiring member is assembled to the first member, when the flexible concentrated wiring member is assembled inside out, a contact portion of the terminal section of the flexible concentrated wiring member is disposed inside out so as to be disconnected with the connection target.

For this reason, the one and the other of the positioning bosses of the first member are formed in such a manner that shapes of lateral cross sections of the positioning bosses are differentiated from each other, in the invention. In this case, the positioning holes of the flexible concentrated wiring member are formed corresponding to the shapes of the positioning bosses. With this, in a case where the flexible concentrated wiring member is inside out in the assembling of the flexible concentrated wiring member, the shapes of the positioning boss and the positioning hole are not matched with each other so that erroneous assembling is not carried out, and thereby a failure of conduction due to erroneous assembling can be prevented from occurring.

Thus, by differentiating the shapes of lateral cross sections of the positioning bosses from each other, it is possible to produce a certain effect in prevention of erroneous assembling of the flexible concentrated wiring member. However, the flexible concentrated wiring member has a ductility as a physicality. Therefore, even in a case where the shapes of the bosses are different from each other in some degree, when it is forcedly pushed thereinto, there is a possibility that the positioning boss breaks the positioning hole so as to allow the flexible concentrated wiring member to be assembled.

For this reason, the invention is configured such that one and the other positioning bosses of the first member are arranged in such a manner that the centers thereof are deviated from each other in a direction perpendicular to the width direction of the loading face. With this configuration, in a case where the flexible concentrated wiring member is assembled to the first member, even when the flexible concentrated wiring member is inside out and the flexible concentrated wiring member is forcedly pushed thereinto, it is not assembled in that condition because the positions of the positioning boss and the positioning hole are not matched with each other. Therefore, it is possible to surely prevent occurrence of a failure of conduction due to erroneous assembling of the flexible concentrate wiring member.

In addition, in a case where shapes of lateral cross sections of one and the other of the positioning bosses of the first member are different from each other and the centers thereof are deviated from each other in a direction perpendicular to the width direction of the loading face, boss escape holes into which the one and other of the positioning bosses are inserted, are respectively formed on the second member in a state that the flexible concentrated wiring member is clamped by the second member and the first member. The boss escape holes formed at one and the other sides are arranged in a point symmetric manner as well as they are formed in such a manner that either of one and the other of the positioning bosses can be inserted into the boss escape holes.

In accordance with the above configuration, in a case where the second member is assembled for supporting the flexible concentrated wiring member so as to cause the flexible concentrated wiring member to be clamped between the second member and the first member, even when the second member faces in any of forward and backward directions in the event of assembling, one and the other of the positioning bosses can be inserted into the respective boss escape holes. Therefore, restriction of the assembling direction, i.e., the forward or backward direction of the second member is eliminated so that it is possible to improve the workability in the assembling.

Advantage Effects of Invention

In accordance with the invention, in a case where the terminal connection tool is assembled to the flexible concentrated wiring member, the assembling can be carried out without deforming the terminal section of the flexible concentrated wiring member so that it is possible to improve the electric reliability of the flexible concentrated wiring connector.

Further, in accordance with the invention, in the case where the terminal connection tool is assembled to the flexible concentrated wiring member, a load applied to the positioning hole can be suppressed so that it is possible to prevent the flexible concentrated wiring member from being damaged.

Moreover, in accordance with the invention, the flexible concentrated wiring member is not erroneously assembled so that it is possible to prevent occurrence of a failure of conduction due to erroneous assembling.

DESCRIPTION OF EMBODIMENTS

First Embodiment

Figure 1:
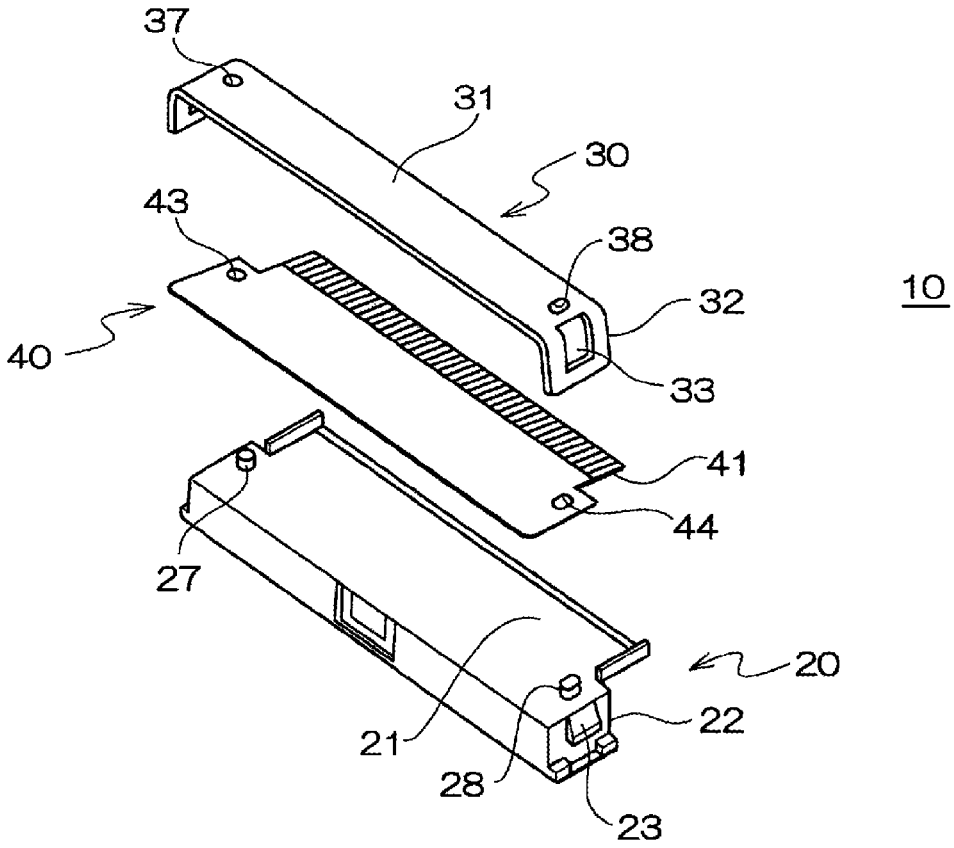
FIG. 1 is an exploded perspective view showing a flexible concentrated wiring connector according to a first embodiment of the invention.
Figure 2:
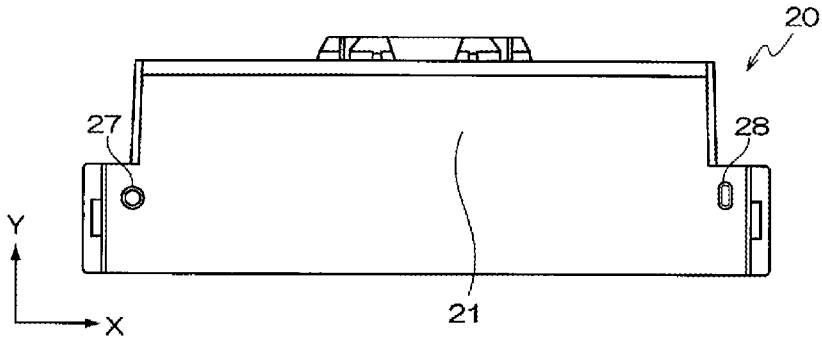
FIG. 2 is a top view showing a slider in the flexible concentrated wiring connector according to the first embodiment.
Figure 3:
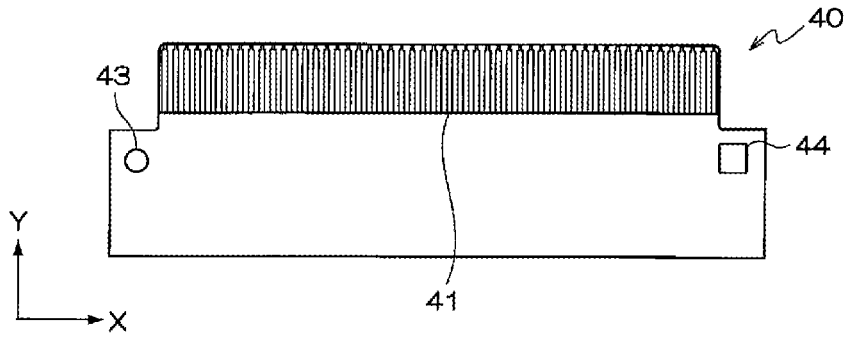
FIG. 3 is a top view showing a flexible concentrated wiring member in the flexible concentrated wiring connector according to the first embodiment.
Figure 4:
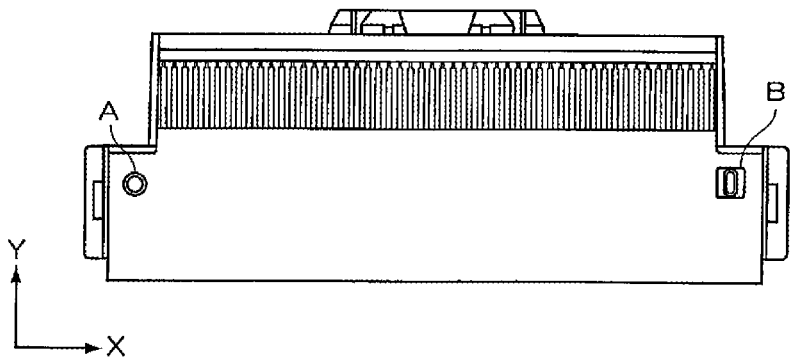
FIG. 4 is a top view showing a state in which the flexible concentrated wiring member is assembled to the slider in the flexible concentrated wiring connector according to the first embodiment.
Figure 5:
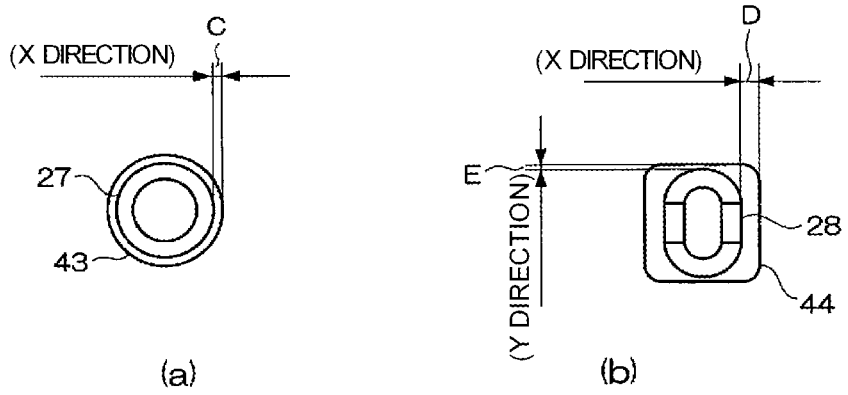
FIGS. 5(*a*) and 5(*b*) are schematic views explanatorily showing a clearance between a positioning hole and a positioning boss in an assembled state in FIG. 4, wherein FIG. 5(*a*) shows a portion A in FIG. 4, and FIG. 5(*b*) shows a portion B in FIG. 4.
Figure 6:
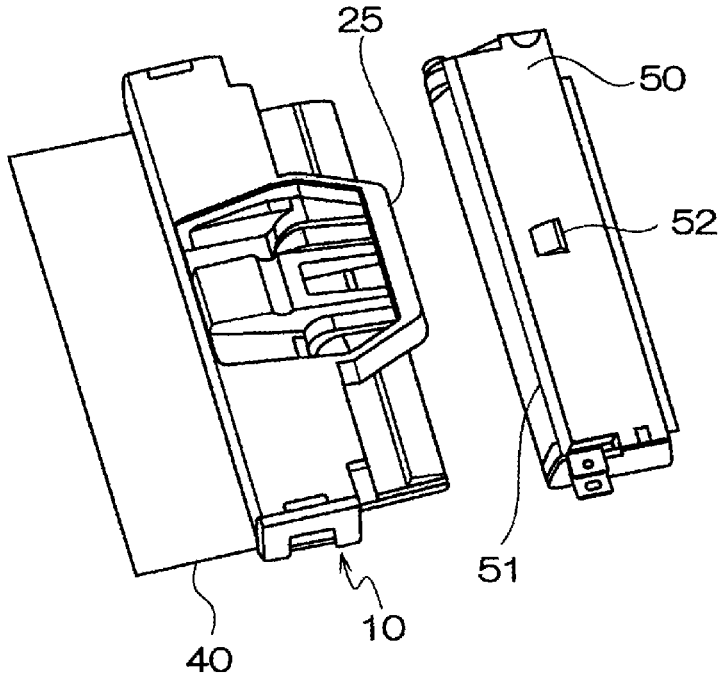
FIG. 6 is a schematic view showing a state just before the flexible concentrated wiring connector of the first embodiment is inserted into and connected to a connector of a connection target.

A first embodiment of a flexible concentrated wiring connector according to a first embodiment of the invention is described below with reference to accompanying drawings. FIG. 1 is an exploded perspective view showing the flexible concentrated wiring connector of the embodiment. FIGS. 2 to 4 are top views respectively showing a slider of the flexible concentrated wiring connector of the embodiment, a flexible concentrated wiring member, and a state in which the flexible concentrated wiring member is assembled to the slider. FIG. 5 is a schematic view explanatorily showing a clearance between a positioning hole and a positioning boss in the assembled state in FIG. 4. FIG. 6 is a schematic view showing a state just before the flexible concentrated wiring connector of the embodiment is inserted into and connected to a connector of a connection target.

As shown in FIG. 1, the flexible concentrated wiring connector 10 of the embodiment is formed of the flexible concentrated wiring member 40, the slider 20 as a first member and a cover 30 as a second member. Here, the slider 20 and cover 30 function as a terminal connection tool.

A loading face 21 on which a terminal section 41 of the flexible concentrated wiring member 40 is mounted, is formed on one face (a top face in the embodiment shown in FIG. 1) of the slider 20 along the longitudinal direction thereof, and peak-like projections 23 are respectively formed at side faces 22 of the slider 20 communicating with both end portions of the loading face 21. Positioning bosses 27 and 28 to be inserted into two positioning holes 43 and 44 which are formed at both outer end portions of the terminal section 41 of the flexible concentrated wiring member 40, are vertically formed at respective both end portions of the loading face 21. The positioning hole 43 is formed in a circular shape corresponding to the positioning boss 27 of which the lateral cross section is formed in a circular shape, and the positioning hole 44 is formed in a rectangular shape corresponding to the positioning boss 28 of which the lateral cross section is formed in an oval shape. This is because that a conductor exposed face of the terminal section 41 of the flexible concentrated wiring member 40 is prevented from being mounted so as to face the loading face 21.

The cover 30 is a member which is adapted to press the terminal section 41 of the flexible concentrated wiring member 40 against the loading face 21 of the slider 20. The cover 30 is configured to have a longitudinal member 31 extending in the width direction of the terminal section 41 of the flexible concentrated wiring member 40 and lock arms 32 as engagement members which are vertically provided downward from the longitudinal member 31 at the respective both ends along the side faces 22 of the slider 20. Openings 33 which can be stopped at the projections 23 on the side faces 22 of the slider 20 are formed on the respective lock arms 32, and the top end of each of the openings 33 in FIG. 1 is formed so as to extend to the end portion of the longitudinal member 31. Boss escape holes 37 and 38 for positioning, into which the positioning bosses 27 and 28 of the slider 20 are respectively inserted, are formed at both end portions of the longitudinal member 31, respectively.

The flexible concentrated wiring connector 10 having the above configuration is assembled in such a manner that the terminal section 41 of the flexible concentrated wiring member 40 is mounted on the loading face 21 of the slider 20, the longitudinal member 31 of the cover 30 is aligned to the terminal section 41 of the flexible concentrated wiring member 40, the lock arms 32 of the cover 30 are pressed down along the side faces 22 of the slider 20, and thereby the openings 33 of the lock arms 32 are latched to the projections 23 at the both side faces 22.

Meanwhile, in the embodiment, a case of a flexible flat cable is taken as an example of the flexible concentrated wiring member 40, the flexible flat cable being configured such that a plurality of foil-like conductors are arranged and are sandwiched by insulation films from both faces, the insulation film at one face (the top face in FIG. 1) is cut out so as to expose the terminals of the respective conductors in order to connect the both ends to other electric circuits. While the flexible concentrated wiring member 40 is generally formed in a desired length, the length is indicated in short in the drawing for simplifying the explanation.

As shown in FIG. 6, the flexible concentrated wiring member 40 to which the slider 20 and the cover 30 are assembled as described above, is inserted into an insertion hole 51 of a connector 50 attached to, for example, a printed circuit board (PCB) (not shown) in such a manner that the conductor exposed face of the terminal section 41 of the flexible concentrated wiring member 40 faces downward in FIG. 6, and thereby the terminal section 41 of the flexible concentrated wiring member 40 is connected to a connection terminal provided in the connector 50.

With this, since even the terminal of the flexible concentrated wiring member 40 having a flexibility is fixed by the terminal connection tool formed of the slider 20 and the cover 30, the flexible concentrated wiring member 40 can be stably inserted into and connected to the connector 50 while overcoming the insertion resistance at a connector 50 side. In addition, in a state that the flexible concentrated wiring member 40 is inserted into and connected to the connector 50, a latch member 25 formed on an opposite face of the loading face 21 of the slider 20 is engaged with a projection 52 of the connector 50 so that the insertion state is to be maintained.

As described above, in a case where the flexible concentrated wiring member 40 is assembled to the slider 20 and the cover 30 as the terminal connection tool, the positioning bosses 27 and 28 formed on the slider 20 and the positioning holes 43 and 44 formed on the flexible concentrated wiring member 40 are used for aligning of the flexible concentrated wiring member 40. That is, in a state that the positioning bosses 27 and 28 are adequately inserted into the positioning holes 43 and 44 adequate aligning can be carried out, and thereby the adequate assembling can be carried out.

However, since the slider 20 is generally formed by a molding process of a synthetic resin, positions of, for example, the positioning bosses 27 and 28 are sometimes varied to be out of a design range. Particularly, a boss pitch between the positioning bosses 27 and 28 which are provided at an interval in the width direction of the slider 20, i.e., in the longitudinal direction, is liable to be largely varied among products. In addition, a boss hole pitch of the flexible concentrated wiring member 40 is also sometimes varied, but not so much as the boss pitch.

In a case where the boss pitch or boss hole pitch is varied, a trouble may occur in the assembling of the flexible concentrated wiring member 40. That is, in a case where the boss pitch is smaller than the boss hole pitch between positioning holes 43 and 44 of the flexible concentrated wiring member 40, the terminal section 41 is deformed at a time point when the bosses 27 and 28 are inserted into the respective positioning holes 43 and 44 so that the terminal section 41 is not able to be brought into intimate contact with the loading face 21. As a result, a failure of contact possibly occurs between the terminal section 41 and the connector 50 of the connection target. In contrast to the above, in a case where the boss pitch is greater than the boss hole pitch, the assembling work itself of the flexible concentrated wiring member 40 becomes difficult. When the assembling is forcedly carried out, an excessive load is applied to the positioning holes 43 and 44 so that the flexible concentrated wiring member 40 or positioning bosses 27 and 28 are possibly damaged.

Here, a characteristic structure of the flexible concentrated wiring member 40 of the embodiment is described below with reference to FIGS. 2 to 5. Meanwhile, in FIGS. 2 to 5, a right-and-left direction (a longitudinal direction) is referred to as an X direction, and a vertical direction is referred to a Y direction.

On the slider 20 in FIG. 2, the positioning bosses 27 and 28 are vertically provided at both end portions in the width direction of the loading face 21, respectively. The shapes of lateral cross sections of the positioning bosses 27 and 28 are different from each other, being circular and oval, respectively. On the flexible concentrated wiring member 40 in FIG. 3, the positioning holes 43 and 44 are formed at both outer end portions in the width direction of the terminal section 41. The shapes of the positioning holes 43 and 44 are different from each other, being circular and rectangular, respectively. FIG. 4 shows a state in which the positioning bosses 27 and 28 of the slider 20 are respectively inserted into the positioning holes 43 and 44 of the flexible concentrated wiring member 40 and assemble thereto.

FIG. 5(*a*) is an enlarged view showing a state in which the positioning boss 27 shown in FIG. 4 is inserted into the positioning hole 43 (hereinafter, referred to as a portion A), and FIG. 5(*b*) is an enlarged view showing a state in which the positioning boss 28 is inserted into the positioning hole 44 (hereinafter, referred to as a portion B). Here, FIG. 5(*a*) shows a state in which the positioning boss 27 is disposed at the center of the positioning hole 43, that is, the positioning boss 27 and the positioning hole 43 are coaxially arranged. FIG. 5(*b*) shows a state in which the positioning boss 28 is disposed at the center of the positioning hole 44, that is, the positioning boss 28 and the positioning hole 44 are coaxially arranged.

As shown in FIG. 5(*a*), a dimension of the outer diameter of the positioning boss 27 is set to be slightly smaller than a dimension of a bore diameter of the positioning hole 43 so as to set a clearance C between the positioning boss 27 and the positioning hole 43. Here, the clearance C means a value of a half of a difference between the dimension of the outer diameter (the external dimension) and the dimension of the bore diameter (the internal dimension) of the positioning hole 43.

On the other hand, as shown in FIG. 5(*b*), the positioning boss 28 is configured such that the external dimension thereof in the X direction is set to be smaller than the external dimension thereof in the Y direction. A clearance D is set in the X direction and a clearance D is set in the Y direction between the positioning hole 44 and the positioning boss 28. Here, the clearance D means a value of a half of a difference between the external dimension of the positioning boss 28 and the internal dimension of the positioning hole 44 in the X direction and the clearance E means a value of a half of a difference between the external dimension of the positioning boss 28 and the internal dimension of the positioning hole 44. The clearance D is set to be greater than the clearance E.

In the flexible concentrated wiring connector 10 of the embodiment, the clearance D is set to be greater than the clearance C so that fitting of the one portion B is set to have a margin. With this, in a case where the positioning hole of the flexible concentrated wiring member 40 is inserted into the positioning hole of the slider 20, it is possible to prevent the flexible concentrated wiring member 40 from being damaged even when the boss pitch of the slider 20 becomes great with respect to the boss hole pitch of the flexible concentrated wiring member 40. In contrast to the above, even when the boss pitch becomes small, assembling can be carried out in a state that the terminal section 41 is in intimate contact with the loading face 21. Accordingly, it is possible to maintain a good contact condition between the terminal section 41 and the connecter 50 of the connection target, thereby improving the electric reliability.

In addition, movement of the terminal section 41 of the flexible concentrated wiring member 40 assembled to the loading face 21 of the slider 20, is restricted by fitting of the portion A, for example, the movement in the X direction of the terminal section 41 is restricted within a range of the clearance C. Therefore, it is possible to suppress the movement of the terminal section 41 in the X direction by setting the clearance to be small.

Here, since the clearance E is set to be smaller than the clearance D, the movement of the terminal section 41 with respect to the loading face 21 is restricted by the clearance C and the clearance E. Consequently, it is possible to suppress the movement of the terminal section 41 in the Y direction by setting the clearance E together with the clearance C to be small. Thus, by making the clearance C and the clearance E as smaller as possible, the movement of the terminal section 41 with respect to the loading face 21 can be suppressed as much as possible in the whole directions so that it is possible to maintain a good connection condition with the connector 50 of the connection target.

Here, for comparison, a related art example of a structure of a flexible concentrate wiring connector is briefly described below. As a structure corresponding to a positioning hole of the embodiment, the following is known (e.g., JP-A-2005-4993). That is, recessed grooves are formed by cutting out both side edges of a flexible concentrated wiring member in U-shapes, positioning bosses of a slider are fitted to the recessed grooves, and thereby a terminal connection tool is assembled to the flexible concentrated wiring member.

However, in the above structure of the recessed grooves, it is necessary to provide a clearance in the X direction on the grooves at the both ends from a designing point of view in consideration of variation of positioning bosses. As a result, the terminal section of the flexible concentrated wiring member possibly moves in the X direction with respect to the loading face. In contrast to the above, the flexible concentrated wiring connector 10 of the embodiment can restrict the movement of the terminal section 41 in the X direction by means of the portion A in accordance with a difference between clearances of the portion A and the portion B in a state that the positioning bosses 27 and 28 of the slider 20 are respectively inserted into the positioning holes 43 and 44.

In accordance with the structure of the recessed grooves of the related art, when an external force in the Y direction acts on the flexible concentrated wiring member 40 with respect to the terminal connection tool, a shear force is insufficient so that the flexible concentrated wiring member 40 is possibly deformed or damaged. In view of this, in accordance with the flexible concentrated wiring connector 10 of the embodiment, since it is premised that the holes are used instead of the recessed grooves, a shear force can be secured rather than a case of the recessed grooves, thereby eliminating the above problem.

In the embodiment, while the description is made based on the example in which the positioning holes 43 and 44 are respectively formed in circular and rectangular shapes and the positioning bosses 27 and 28 are respectively formed in circular and oval shapes, the invention is not limited to the structures of shapes. To be brief, of course, the connector with change in designing or the like is involved in the invention as long as the clearances of the portion A and the portion B have a predetermined relationship according to the invention.

Second Embodiment

Figure 7:
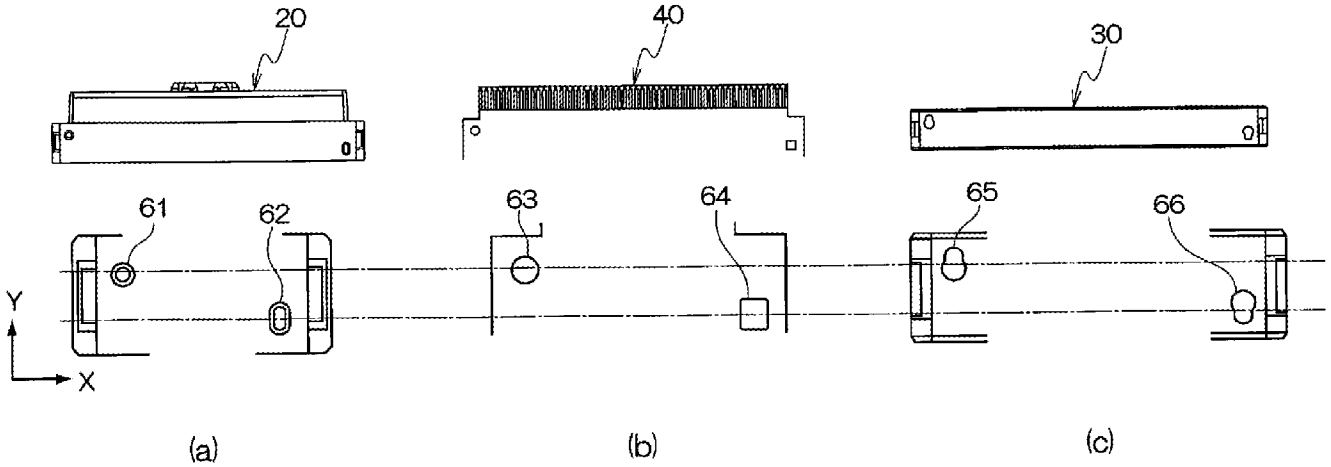
FIG. 7 is a schematic view explanatorily showing a positional relationship among (a) a positioning boss of the slider, (b) a positioning hole of the flexible concentrated wiring member and (c) a boss escape hole of a cover according to a second embodiment of the invention.
Figure 8:
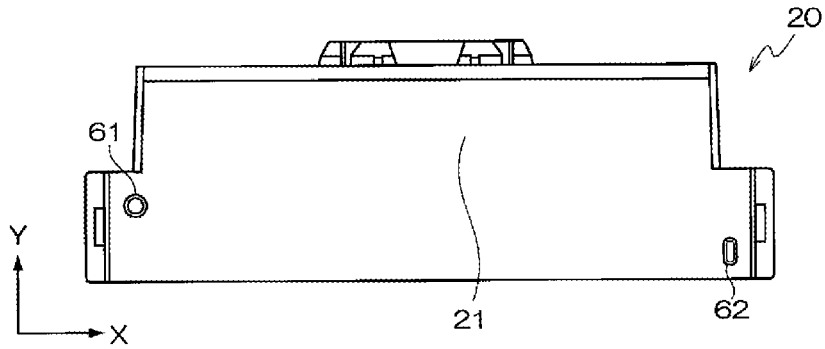
FIG. 8 is a top view showing the slider of the second embodiment.
Figure 9:
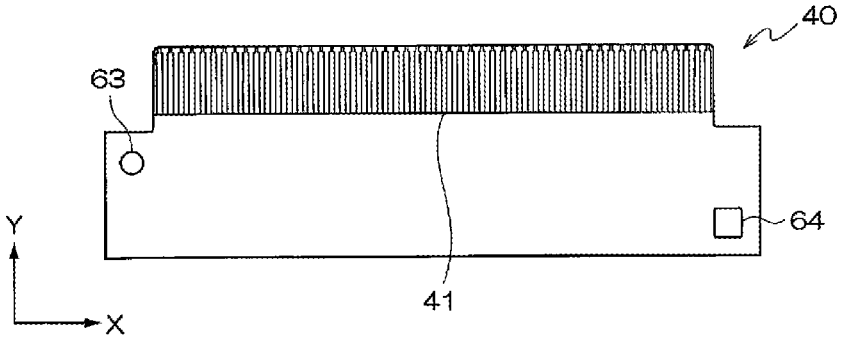
FIG. 9 is a top view showing the flexible concentrated wiring member according to the second embodiment.
Figure 10:
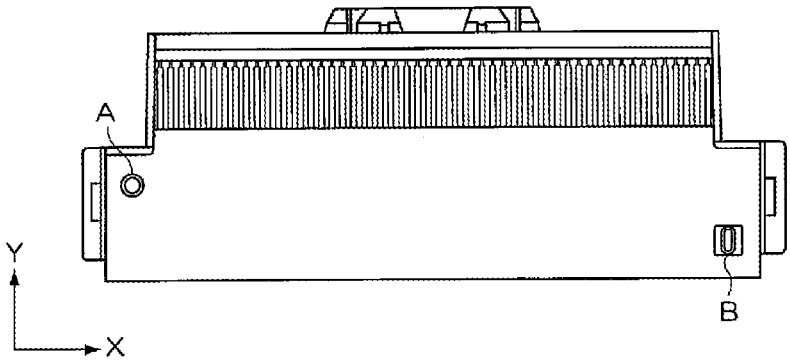
FIG. 10 is a top view showing a state in which the flexible concentrated wiring member is assembled to the slider according to the second embodiment.
Figure 11:
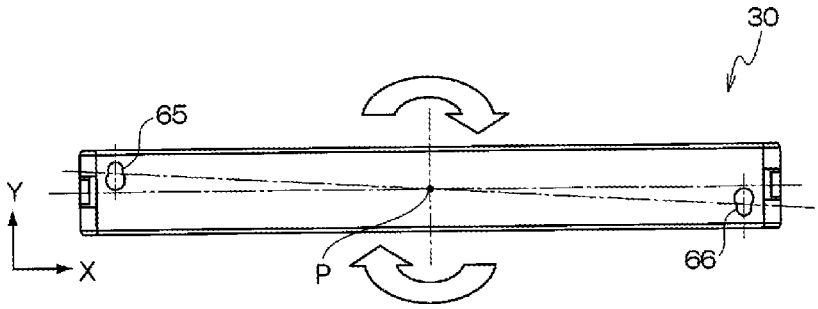
FIG. 11 is a schematic view explanatorily showing a positional relationship between two boss escape holes according to the second embodiment.
Figure 12:
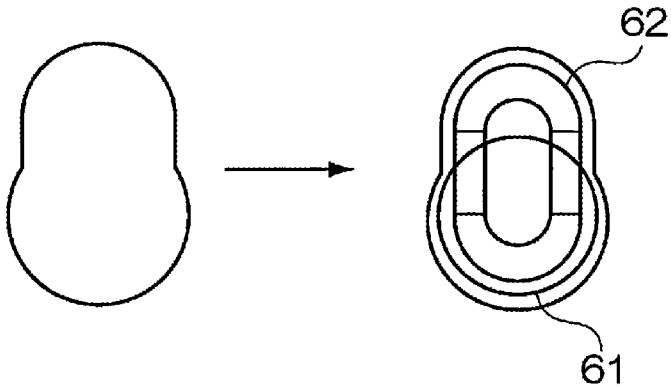
FIG. 12 is a schematic view explanatorily showing a shape of the boss escape hole according to the second embodiment.
Figure 13:
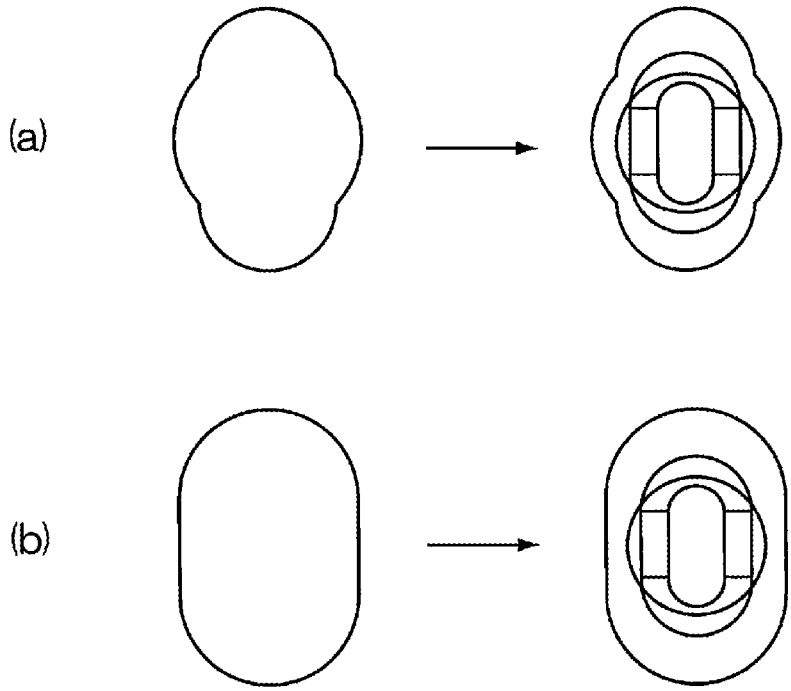
FIGS. 13(*a*) and 13(*b*) are schematic views explanatorily showing another shape of the boss escape hole.
Figure 14:
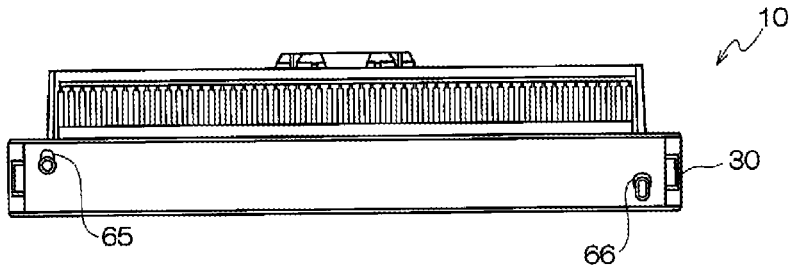
FIG. 14 is a top view showing a state in which the slider, the flexible concentrated wiring member and the cover are assembled to one another according to the second embodiment.

A second embodiment of the flexible concentrated wiring connector according to the invention is described below with reference to accompanying drawings. FIG. 7 is a schematic view explanatorily showing positional relationships among (a) positioning bosses of a slider, (b) positional holes of a flexible concentrated wiring member and (c) boss escape holes of a cover. FIG. 8 is a top view showing the slider, FIG. 9 is a top view showing the flexible concentrated wiring member and FIG. 10 is a top view showing a state in which the flexible concentrated wiring member is assembled to the slider. FIG. 11 is a schematic view explanatorily showing a positional relationship between the two boss escape holes of the cover. FIG. 12 is a schematic view explanatorily showing shapes of the boss escape holes, and FIGS. 13(*a*) and 13(*b*) are schematic views explanatorily showing other shapes of boss escape holes. FIG. 14 is a top view showing a state in which the slider, the flexible concentrated wiring member and the cover are assembled to one another. Meanwhile, structures the same as in the first embodiment are denoted by the same symbols, and descriptions thereof are omitted. Further, descriptions of operations and effects the same as in the first embodiment are also omitted.

In the embodiment, as shown in FIG. 7, (a) positioning bosses 61 and 62 of the slider 20 are arranged in such a manner that the boss centers are deviated from each other in the Y direction, (b) positioning holes 63 and 64 of the flexible concentrated wiring member 40 and (c) the boss escape holes 65 and 66 of the cover 30 are arranged corresponding to the above bosses in such a manner that the respective hole centers are deviated from each other in the Y direction. A deviation amount of the boss centers of the positioning bosses 61 and 62 in the Y direction, a deviation amount of the hole centers of the positioning holes 63 and 64 in the Y direction and a deviation amount of the hole centers of the boss escape holes 65 and 66 in the Y direction are not particularly limited. However, in the embodiment, the respective bosses or holes are arranged with an interval therebetween so as not to be overlapped with each other in the Y direction.

As shown in FIGS. 8 and 9, the positioning hole 63 is formed in a circular shape corresponding to the positioning boss 61 of which the lateral cross section is formed in a circular shape, and the positioning hole 64 is formed in a rectangular shape corresponding to the positioning boss 62 of which the lateral cross section is formed in an oval shape. As shown in FIG. 10, when the flexible concentrated wiring member 40 is assembled to the slider 20, they go into a state in which the positioning boss 61 is inserted into the positioning hole 63 as well as the positioning boss 62 is inserted into the positioning hole 64. At the portion A and the portion B, the clearances between the positioning bosses and the positioning holes can be set similarly to the first embodiment.

Meanwhile, in the case where the flexible concentrated wiring member 40 is assemble to the slider 20, since the shapes of the lateral cross sections of the positioning bosses 27 and 28 are different from each other in the first embodiment, it is possible to produce a certain effect in prevention of erroneous assembling in which the conductor exposed face of the terminal section 41 of the flexible concentrated wiring member 40 faces the loading face 21 of the slider 20. However, the flexible concentrated wiring member 40 has a ductility as a physicality. Therefore, even in a case where only the shapes of the bosses are different from each other in some degree, when the flexible concentrated wiring member 40 is forcedly pushed in a state that the assembling direction of the flexible concentrated wiring member 40 is inverted between the forward and backward directions, there is a possibility that the positioning boss breaks the positioning hole to go into the positioning hole, and thereby the flexible concentrated wiring member 40 is assembled.

In contrast to the above, in accordance with the embodiment, even in a case where the assembling direction of the flexible concentrate wiring member 40 is inverted between the forward and backward directions in the event of assembling of the flexible concentrate wiring member 40, the positions of the positioning boss 61 and the positioning hole 64, and the positions of the positioning boss 62 and the positioning hole 63 are not respectively aligned in the Y direction nor overlapped with each other. Therefore, even when the flexible concentrate wiring member 40 is forcedly pushed, the positioning bosses are not inserted into the positioning holes. Consequently, the conductor exposed face of the terminal section 41 of the flexible concentrate wiring member 40 is not assembled to the loading face 21 of the slider 20 so that it is possible to surely prevent erroneous assembling of the flexible concentrate wiring member 40. Accordingly, it is possible to prevent occurrence of a failure of conduction due to erroneous assembling of the flexible concentrate wiring connector 10.

On the other hand, the shapes of the boss escape holes 65 and 66 of the cover 30 are not necessarily matched with the shapes of the positioning holes 63 and 64 of the flexible concentrate wiring member 40. While predetermined shapes are set to the positioning holes 63 and 64 in order to achieve the clearances defined by the positioning bosses 61 and 62, it is not necessary to set severe clearances like those of the positioning holes 63 and 64 to the boss escape holes 65 and 66 because they are only escape holes for the positioning bosses 61 and 62, that is, it is sufficient that the boss escape holes 65 and 66 are formed to be just greater than the positioning holes.

Consequently, in the embodiment, the boss escape holes 65 and 66 of the cover 30 are arranged in a point symmetric manner viewed from the attaching direction thereof, and the positioning bosses 61 and 62 are formed so as to be respectively inserted thereinto. The arrangement and the shapes of the boss escape holes 65 and 66 are described below.

As shown in FIG. 11, the boss escape holes 65 and 66 are arranged on positions which are in a point symmetric manner with respect to a point P, and are formed in shapes of which front and rear sides are inverted in the Y direction. In addition, the boss escape holes 65 and 66 are formed in shapes each of which is determined by a contour obtained by overlapping the positioning bosses 61 and 62 and a predetermined clearance added thereto. Moreover, as shown in FIG. 12, the boss escape holes 65 and 66 can be formed in shapes each of which is determined by a contour obtained by overlapping the circular positioning boss 61 and the oval positioning boss 62 and a predetermined clearance added thereto.

In accordance with the above configuration, even when the assembling direction of the cover 30, i.e., the front or rear side in the Y direction (a relationship of inverting a direction of arrow in FIG. 11 by 180 degrees) is not limited, the positioning bosses 61 and 62 can be simultaneously inserted into the boss escape holes 65 and 66 so that a working time period in the assembling can be reduced, thereby improving the workability.

It is sufficient that both of the boss escape holes 65 and 66 are formed in shapes so as to allow the positioning bosses 61 and 62 to be inserted thereinto irrespective of the assembling direction of the cover 30. For example, the shapes can be set in such a manner that contours of the original positioning bosses 61 and 62 are overlapped with contours of the positioning bosses 61 and 62 at a time when they are rotated by 180 degrees around a center of a line connecting the original positioning bosses 61 and 62 as a rotation center, and predetermined clearances are provided on the respective overlapped contours. As shown in FIG. 13A, in a case where the positioning bosses 61 and 62 are overlapped at the center, it is sufficient that a predetermined clearance is set to the overlapped contour. When the clearance is enlarged more, it is possible to make the shape to be a simple oval one as shown in FIG. 13B.

FIG. 14 shows an appearance of the flexible concentrated wiring connector 10 in a state that the cover 30 is assembled for supporting the flexible concentrated wiring member 40 so as to cause it to be clamped between the cover 30 and the slider 20. It shows a state in which the positioning bosses 61 and 62 are inserted into the respective boss escape holes 65 and 66 of the cover 30 and gaps are formed therebetween. Even when the gaps are formed at the boss escape holes 65 and 66, a function of the cover 30 is not influenced thereby.

In accordance with the embodiment, in the case where the flexible concentrated wiring member 40 is assembled to the slider 20, it is possible to completely prevent erroneous assembling in which the assembling direction of the flexible concentrated wiring member 40 is inverted between the forward and backward directions so that it is possible to prevent degradation of quality of the flexible concentrated wiring connector 10 due to a failure of conduction or the like. In addition, in accordance with the embodiment, in the case where the cover 30 is assembled by clamping the flexible concentrated wiring member 40 between the slider 20 and the cover 30, it is not necessary to fix the forward or backward direction of the cover 30 so that a time period for aligning the orientation of the cover 30 can be reduced, thereby improving the workability in the assembling.

While the invention is described in detail by referring to the specific embodiment, it is understood by those of ordinary skill in the art that various modifications and changes can be made without departing from the sprit and scope of the invention.

This application is based on Japanese Patent Application (JP-2009-182755) filed on Aug. 5, 2009, the contents of which are incorporated herein by reference.

DESCRIPTION OF REFERENCE NUMERALS AND SIGNS

10 flexible concentrated wiring connector
20 slider
21 loading face
27, 28, 61, 62 positioning boss
30 cover
37, 38, 65, 66 boss escape hole
40 flexible concentrated wiring member

41 terminal section
43, 44, 63, 64 positioning hole
50 connector
C, D, E clearance

The invention claimed is:

1. A flexible concentrated wiring connector that supports a terminal section of a flexible concentrated wiring member and is fitted to a mating connector when the terminal section is inserted into and connected to the mating connector, the flexible concentrated wiring connector comprising:

the flexible concentrated wiring member;

a first member having a loading face on which the terminal section of the flexible concentrated wiring member is mounted; and a second member that supports the flexible concentrated wiring member so that the flexible concentrated wiring member is clamped between the second member and the first member and presses the terminal section against the loading face, wherein positioning bosses are vertically provided on the first member at respective both end portions at the outer sides in the width direction of the loading face, and positioning holes into which the positioning bosses are to be inserted are provided on the flexible concentrated wiring member at respective both end portions at the outer sides in the width direction of the terminal section;

wherein a difference between an internal dimension of one of the positioning holes and an external dimension of one of the positioning bosses in the width direction of the flexible concentrated wiring member in a state that the one of the positioning bosses is inserted into the center of the one of the positioning holes, is referred to as a first clearance;

wherein a difference between an internal dimension of the other of the positioning holes and an external dimension of the other of the positioning bosses in the width direction of the flexible concentrated wiring member in a state that the other of the positioning bosses is inserted into the center of the other of the positioning holes, is referred to as a second clearance; and wherein the second clearance is set to be greater than the first clearance, wherein the one or the other of the positioning bosses of the first member are arranged so that the centers thereof are deviated from each other in a direction perpendicular to the width direction of the loading face; and wherein boss escape holes, into which the one or the other of the positioning bosses are inserted in a state that the flexible concentrated wiring member is clamped between the second member and the first member, are respectively formed on the second member, the positioning boss escape holes formed on one and other sides are arranged in a point symmetrical manner, and the boss escape holes are formed so that the one and the other of the positioning bosses can be inserted thereinto.

2. The flexible concentrated wiring connector according to claim 1, wherein the second clearance is set within a range in which the terminal section is intimately contactable with the loading face in the width direction thereof when the flexible concentrated wiring member is assembled to the first member.

3. The flexible concentrated wiring connector according to claim 1, wherein the one of the positioning bosses is different in shape of a lateral cross section from the other of the positioning bosses.

4. The flexible concentrated wiring connector according to claim 1, wherein the one and the other of the positioning bosses are arranged so that the centers thereof are deviated from each other in a direction perpendicular to the width direction of the loading face.

5. The flexible concentrated wiring connector according to claim 1, wherein the one and the other of the positioning bosses are arranged so that the centers thereof are deviated from each other in a direction perpendicular to the width direction of the loading face.

6. A flexible concentrated wiring connector that supports a terminal section of a flexible concentrated wiring member and is fitted to a mating connector when the terminal section is inserted into and connected to the mating connector, the flexible concentrated wiring connector comprising:

the flexible concentrated wiring member;

a first member having a loading face on which the terminal section of the flexible concentrated wiring member is mounted; and a second member that supports the flexible concentrated wiring member so that the flexible concentrated wiring member is clamped between the second member and the first member and presses the terminal section against the loading face, wherein positioning bosses are vertically provided on the first member at respective both end portions at the outer sides in the width direction of the loading face, and positioning holes into which the positioning bosses are to be inserted are provided on the flexible concentrated wiring member at respective both end portions at the outer sides in the width direction of the terminal section;

wherein a difference between a bore diameter of one of the positioning holes and an outer diameter of one of the positioning bosses in a state that the one of the positioning bosses is inserted into the center of the one of the positioning holes, is referred to as a first clearance;

wherein a difference between an internal dimension of the other of the positioning holes and an external dimension of the other of the positioning bosses in the width direction of the flexible concentrated wiring member in a state that the other of the positioning bosses is inserted into the center of the other of the positioning holes, is referred to as a second clearance;

wherein a difference between an internal dimension of the other of the positioning holes and an external dimension of the other of the positioning bosses in a direction perpendicular to the width direction of the flexible concentrate wiring member in a state that the other of the positioning bosses is inserted into the center of the other of the positioning holes, is referred to as a third clearance; and wherein the second clearance is set to be greater than both the first clearance and the third clearance, wherein the one or the other of the positioning bosses of the first member are arranged so that the centers thereof are deviated from each other in a direction perpendicular to the width direction of the loading face; and wherein boss escape holes, into which the one or the other of the positioning bosses are inserted in a state that the flexible concentrated wiring member is clamped between the second member and the first member, are respectively formed on the second member, the positioning boss escape holes formed on one and other sides are arranged in a point symmetrical manner, and the boss escape holes are formed so that the one and the other of the positioning bosses can be inserted thereinto.

7. The flexible concentrated wiring connector according to claim 6, wherein the second clearance is set within a range in which the terminal section is intimately contactable with the loading face in the width direction thereof when the flexible concentrated wiring member is assembled to the first member.

8. The flexible concentrated wiring connector according to claim 6, wherein the one of the positioning bosses is different in shape of a lateral cross section from the other of the positioning bosses.

* * * * *